US008317660B2

(12) United States Patent
Goranson

(10) Patent No.: US 8,317,660 B2
(45) Date of Patent: Nov. 27, 2012

(54) YOGA MAT WITH POSE MARKINGS

(76) Inventor: Elizabeth Goranson, Natick, MA (US)

( * ) Notice: Subject to any disclaimer, the term of this patent is extended or adjusted under 35 U.S.C. 154(b) by 14 days.

(21) Appl. No.: 12/615,330

(22) Filed: Nov. 10, 2009

(65) Prior Publication Data

US 2011/0111926 A1 May 12, 2011

(51) Int. Cl.
*A63B 21/00* (2006.01)

(52) U.S. Cl. ..... 482/23; 434/25; 434/148

(58) Field of Classification Search ..... 434/250; 482/23, 35, 148, 907
See application file for complete search history.

(56) References Cited

U.S. PATENT DOCUMENTS 1,484,390 A * 2/1924 Gibbs et al. ..... 434/252
D382,902 S 8/1997 Feldman
6,387,013 B1 5/2002 Marquez
7,108,635 B2 9/2006 Howlett-Campanella
7,465,263 B1 12/2008 Conrad
7,955,224 B2 * 6/2011 Curley ..... 482/23
2002/0142888 A1 * 10/2002 Marques ..... 482/23
2004/0229731 A1 11/2004 Mitchell
2006/0154220 A1 * 7/2006 Toniolo ..... 434/250
2009/0062076 A1 3/2009 Curley
2010/0048356 A1 2/2010 Hamilton

* cited by examiner

*Primary Examiner* — Jerome W Donnelly

(57) ABSTRACT

A mat for learning, teaching, and performing yoga is provided in which the upper surface of the mat includes visually discernable floor-contacting body part markings. Sets of the markings can be used by yoga practitioners to facilitate proper positioning for one or more yoga poses. In another aspect of the invention, mats can be made for practitioners of different sizes and abilities by varying the spacing of the sets of markings for the poses. Further, an image of the mat can be represented on another medium, such as a card, poster, or video, on which a pose is depicted and the representations of the markings of the mat for that pose can be highlighted.

1 Claim, 3 Drawing Sheets

YOGA MAT WITH POSE MARKINGS

CROSS-REFERENCE TO RELATED APPLICATIONS

None.

STATEMENT REGARDING FEDERALLY SPONSORED RESEARCH OR DEVELOPMENT

Not applicable.

FIELD OF THE INVENTION

The invention is in the yoga mat and yoga learning/instruction fields.

BACKGROUND OF THE INVENTION

Beginning yoga practitioners are often advised to build poses from the ground up when attempting to perform a wide variety of yoga postures. Yoga poses are often classified in terms of which parts of the body are contacting the floor while the pose is being performed. According to one such classification scheme, yoga poses are categorized as Standing Poses (both feet contacting the floor), Balancing Poses (one foot contacting the floor), Arm Balancing Poses (at least one hand contacting the floor), Sitting Poses (the sitting bones contacting the floor), etc. For yoga practitioners, the positioning of the body parts contacting the floor is an important initial consideration when learning to correctly assume the various yoga postures. Once this foundation for the pose is properly engaged, the positioning of body parts which do not contact the floor can be accomplished in order to complete the intended pose. Learning to set up this foundation of proper positioning of floor-contacting body parts may aid in reducing the risk of injury and increasing the benefits of yoga practice.

The process of setting up foundations of floor-contacting body parts for a yoga pose can be accomplished in several ways. The yoga practitioner can simply attempt to mimic a pose demonstrated by a live person, or an image of a person, often with adjustments subsequently made either based on the advice of an instructor or the practitioner's own knowledge. Additionally, the yoga practitioner can make use of visual alignment references to assist in the optimal orientation and spacing of the body parts that contact the floor. Visual alignment references are generally helpful to yoga practitioners as they learn to coordinate the various parts of the body to perform poses. Such references might include fixed aspects of the room in which the practice is taking place, such as floorboards, or yoga mats, which are commonly employed during yoga practice.

Prior art yoga mats, such as those described in U.S. Pat. Nos. 6,387,013 and 7,108,635, provide visual alignment references printed on the mat. The alignment references typically consist of grids of perpendicular lines or regular arrays of angled and straight lines. Such alignment mats can be used by a knowledgeable practitioner to assist in both the building of the foundation of a yoga pose and the subsequent alignment of other non-contacting body parts.

Yoga alignment mats appear abstract and are not intuitively related to any particular pose foundations. Such mats are not optimal for assisting practitioners to set a foundation for many yoga poses, especially for beginning yoga students, younger students, special-needs students, and students with certain learning styles. Therefore, a need exists for instructional yoga mats and materials that are designed to facilitate proper positioning for yoga poses in a less abstract, more intuitive manner.

SUMMARY OF THE INVENTION

Accordingly, it is an object of this invention to provide a yoga mat with floor-contacting body part markings for foundations for yoga poses. A plurality of such markings or sets of markings may be provided on a single mat. It is a further object of the invention to provide instructional media that are coordinated with mats of this invention wherein a display is provided that includes a representation of the mat and the markings for a pose along with a depiction in the same field of view of a demonstration of that pose. It is still further an object of the invention to provide mats with the floor-contacting body part markings positioned differently based on the size of the user. Finally, it is an object of the invention to provide a group mat or floor space that has a plurality of areas with sets of these markings so that more than one practitioner can participate or be instructed in a group setting.

DETAILED DESCRIPTION OF THE INVENTION

Figure 3:
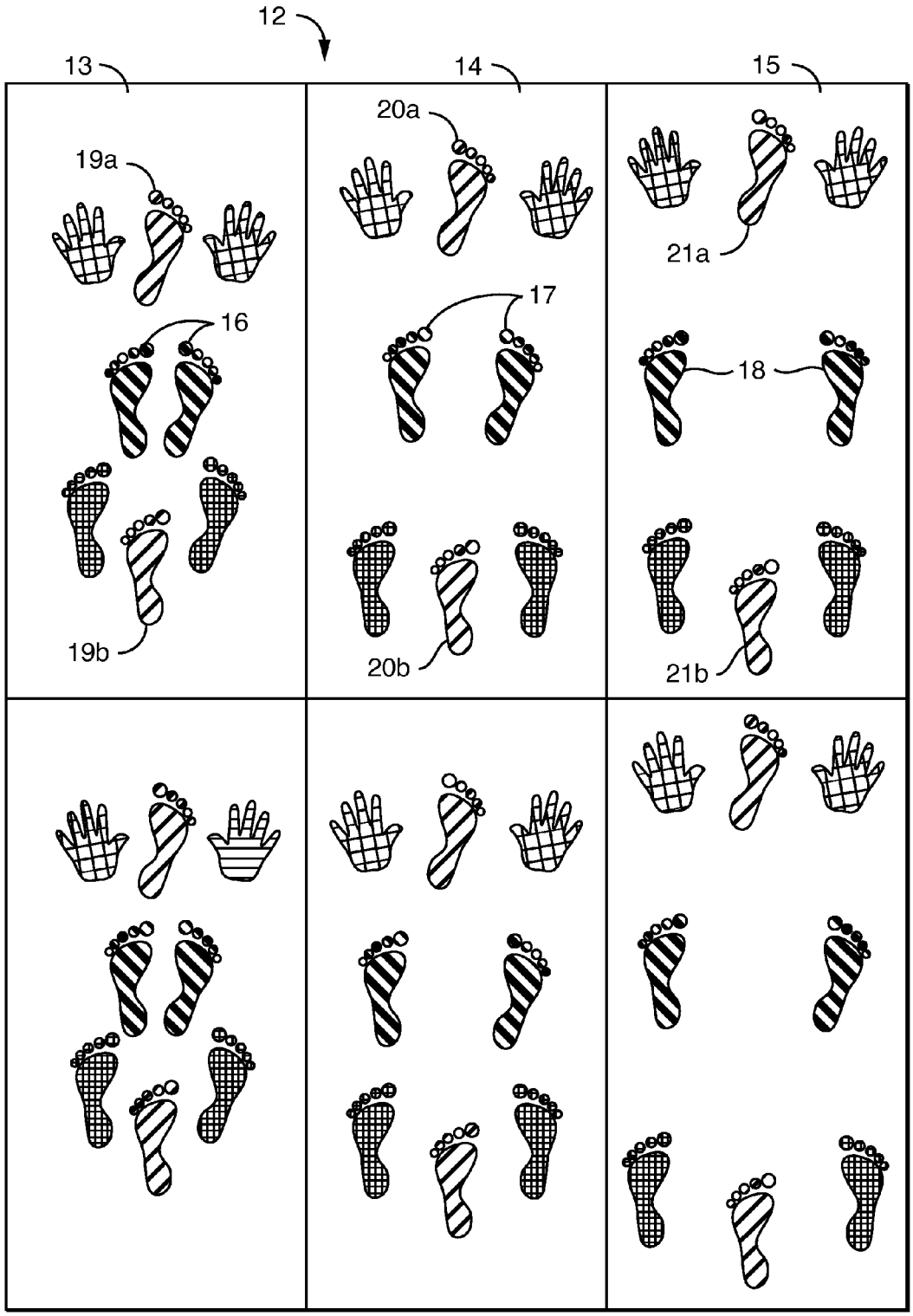
FIG. 3 shows a group mat in accordance with an aspect of an embodiment of the present invention.

A variety of types and styles of yoga and exercise mats are known. Yoga mats are often about 24 inches by 68 inches in size, though any suitable shape or size can be used in accordance with the invention. Yoga mats of this invention may also be sufficiently large to accommodate multiple individuals simultaneously, such as in a class setting, as shown in FIG. 3.

Figure 1:
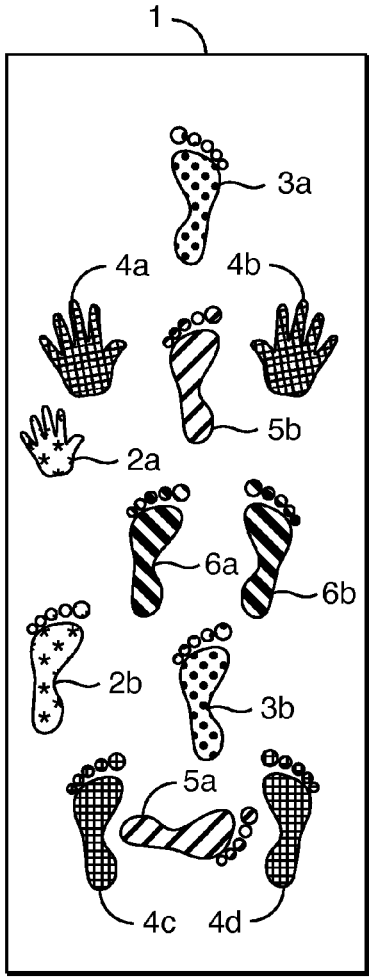
FIG. 1 shows a mat in accordance with an aspect of an embodiment of the present invention.
Figure 4:
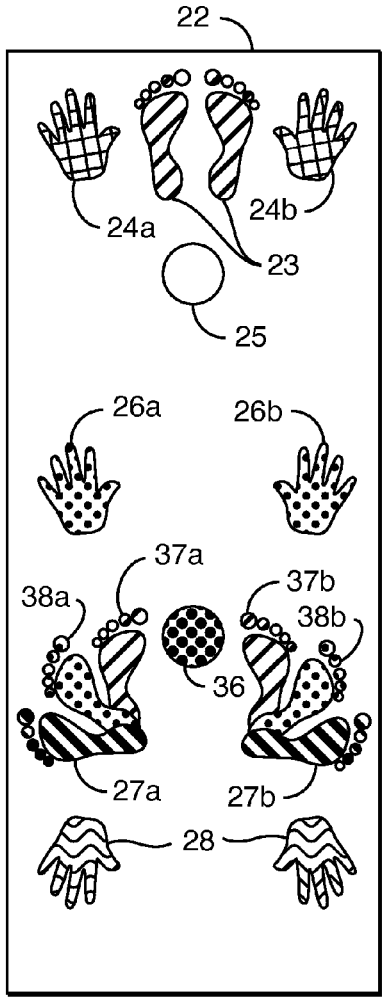
FIG. 4 shows a mat in accordance with an aspect of another embodiment of the present invention.

Referring to FIG. 1, yoga mat 1 includes markings for floor-contacting body parts for yoga poses. The upper surface of yoga mat 1 can be printed with markings 2*a*-6*b*. Preferably, the markings or indicia are representative of the body part that should be in contact with a given marking during a yoga pose, such as left and right footprints for feet or left and right handprints for hands as shown in the accompanying drawings, although any markings that are distinguishable by shape, color, shading, and/or patterning could be appropriate. Markings that together can be used to form floor-contacting body part foundations for a particular pose can be made the same color, pattern, shading or other appropriate visually discernible feature, indicated in the accompanying figures by the use of the same fill or cross-hatching. For example, in FIG. 1, handprints 4*a* and 4*b* are filled with the same pattern as footprints 4*c* and 4*d*. These four markings can be used as a set of markings for the foundation for a pose such as "Downward Facing Dog" (Adho Mukha Svanasana). Preferably, markings that can be used for the foundations for the most common or fundamental poses would be correlated in this manner. However, markings that do not have the same fill can also be used together for foundations for poses. For example, in FIG. 1, footprints 6*a* and 6*b* (filled with stripes) could be used together with handprints 4*a* and 4*b* (filled with grid lines) for a foundation for a "Crow" (Bakasana) pose. Similarly, referring to FIG. 4, footprints 23 (filled with stripes) and handprints 26*a* and 26*b* (filled with dots) could be used as a foundation for an "Inclined Plane" (Purvottanasana) pose. FIG. 4 also includes markings that correspond to additional floor-contacting body parts, such as forehead and sitting bones, as in marking 25 and marking 36. Other markings, such as for forearms (not shown) could be used. In an alternative manner of distinguishing markings, the markings could be distinguished texturally.

In use, a practitioner preparing to get into a particular yoga pose locates the markings that correspond to the foundation for that pose and places the corresponding body parts on the respective floor-contacting body part markings in the orientation of each marking (if the marking has an orientation, such as is the case with handprints, which have both a handedness (part of the shape) and a direction (orientation).) The markings that can be used to form a foundation for a pose can be determined based on instructions from an instructor or based on information provided through another medium such as a picture. For example, referring to FIG. 1, a pose foundation may consist of stripe-filled left footprint marking 6*a* together with grid-patterned left handprint marking 4*a*. A practitioner would place his left foot on marking 6*a* in the orientation of marking 6*a* and left hand on marking 4*a* in the orientation of marking 4*a* and thus be in the foundational position to form the rest of the pose.

It will be appreciated that more than one pose may correspond to a group of markings in that the same set of markings may sometimes form the foundation for different poses. In addition, it will be appreciated that mats may be designed with markings for as few as one or two particular poses or for many poses by altering the number and type of markings, which can be selected depending on the needs and abilities of the intended user.

In another embodiment of the present invention, shown for example in FIG. 3, a larger mat 12 or floor space, which may be used in a class setting. Mat 12 is divided into six areas (for example, area 13) such that each area contains floor-contacting body part markings for a selection of yoga poses.

In accordance with another aspect of the invention, yoga mats may include markings for floor-contacting body parts that are variously sized and spaced to accommodate the size and abilities of different practitioners. For example, as shown on larger mat 12 of FIG. 3, the spacing varies between footprint markings in footprint sets 16, 17, and 18 on mat sections 13, 14, and 15, respectively. Footprint set 16, with footprint markings set closer together would be for a smaller individual whereas set 18 would be for a larger practitioner. Another example of variations in spacing of sets of markings is shown in sets 19*a*-19*b*, 20*a*-20*b*, and 21*a*-21*b* on mat sections 13, 14, and 15 shown in FIG. 3. It will be understood that many different sizes and spacings are possible and of course that the markings on individual mats could be designed for persons of different sizes as well.

Figure 2:
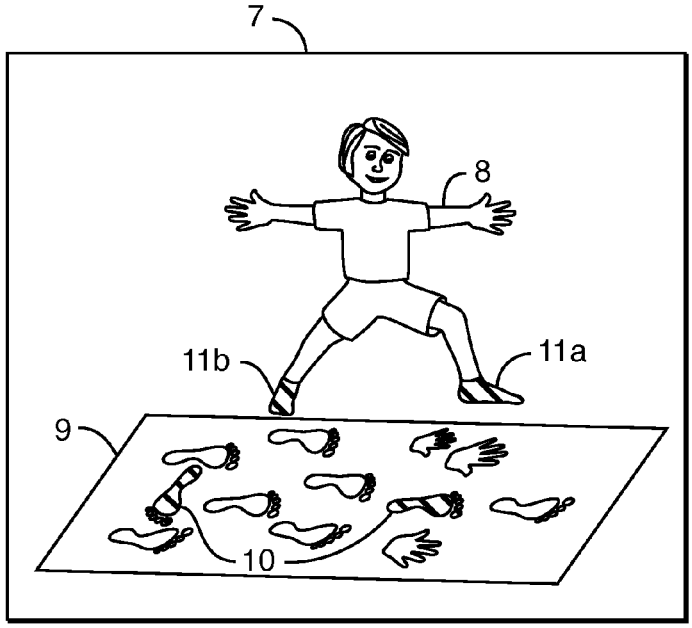
FIG. 2 depicts a card in accordance with an aspect of an embodiment of the present invention.

A further aspect of the invention involves the use of an instructional medium that is correlated with the floor-contacting body part markings of the mat. FIG. 2 shows a card 7 that includes an image of a person 8 in a yoga pose. Also included on card 7 is an image 9 that is representative of mat 1 of FIG. 1. Image 9 on card 7 depicts the markings of mat 1 in a manner such that the markings used for the pose of person 8 can be easily discerned. Preferably, a card for a particular pose will highlight or only color, pattern, or shade the representations of the markings used for the foundation for that pose while depicting the representations for the other markings as outlines or in gray to aid the user in finding the markings for that pose. Also, preferably, the body parts of person 8 that are floor-contacting for the pose shown on the card can be highlighted, preferably with the same highlighting, color, pattern or shading as the corresponding markings on the image of the mat and the markings on the mat itself. For example, in FIG. 2 the feet 11*a* and 11*b* of person 8 are striped in the same manner as corresponding footprint markings 10 on image 9, which in turn correspond with striped footprint markings 5*a* and 5*b* on the actual mat 1.

Figure 5:
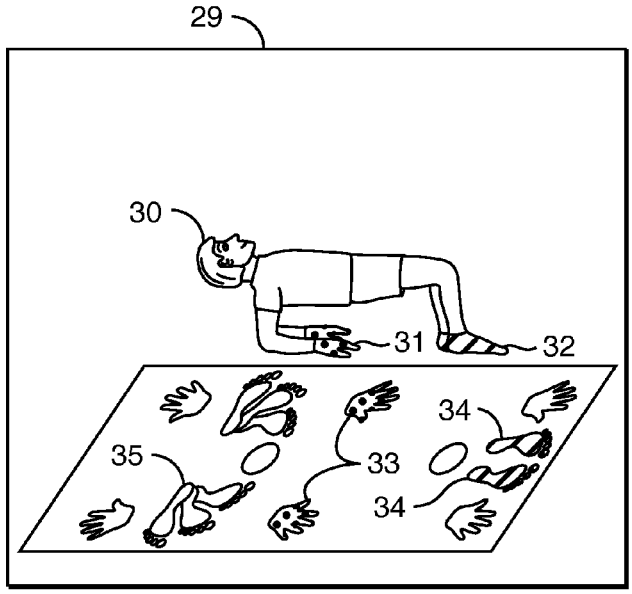
FIG. 5 depicts a card in accordance with an aspect of another embodiment of the present invention.

FIGS. 4 and 5 further illustrate this correlated-instructional-medium aspect of the invention. FIG. 5 shows card 29, which depicts person 30 in a yoga pose. Also shown on card 29 is a representation of the mat 22 of FIG. 4. In this example, the floor-contacting body parts for the pose are hands 31 and feet 32 of person 30. The corresponding markings on the representation of mat 22 are handprint marking 33 and footprint marking 34, which in turn correspond to footprint markings 23 and handprint markings 26*a* and 26*b* of mat 22. The hands 31 on the image, the handprint markings 33 on the image, and handprint markings 26*a* and 26*b* on the mat are all filled in the same manner (all with dots), as are feet 32 on the image, footprint markings 34 on the image, and footprint markings 23 on the mat (all with stripes). The other markings of mat 22 on card 29 are shown in outline only, i.e., they are not highlighted, colored, patterned or shaded, so that the markings correlated with the depicted pose are more easily located.

A correspondence between instructional media depicting a pose and the mat on which the pose is done as described above further assists practitioners in properly setting up the foundation of the pose. Many types of media can be used to depict an image of the mat with its markings along with an image of a pose, preferably in the same field of view. In addition to cards, other possibilities include posters, books, drawings, computer images, and videos. Videos may include animated demonstrations of the poses or show live action poses with graphics overlaid or inset to depict the image of the mat with highlighted markings.

The invention claimed is:

1. A yoga mat comprising:

an exercise mat with an upper surface and a lower surface;

a plurality of floor-contacting body part pose markings on the upper surface wherein the pose markings are visually distinguishable from each other and are positioned so that a plurality of sets of the pose markings correspond with floor-contacting body part foundations for at least one yoga pose; wherein the yoga mat is elongated and includes a distal end, a center area, and a proximal end and the upper surface of the mat further includes:

a pair of handprints near the proximal end that are oriented toward the proximal end and have the same fill;

a pair of handprints near the distal end that are oriented toward the distal end and have the same fill that is distinguishable from the fill of said proximal handprints;

a pair of handprints near the center area that are oriented toward the distal end and have the same fill that is distinguishable from the fills of said proximal handprints and said distal handprints;

a pair of footprints near the center area that are oriented toward the distal end and have the same fill that is distinguishable from the fills of said proximal handprints, said distal handprints, and said center area handprints;

a pair of footprints near the distal end that are oriented toward the distal end and have the same fill that is distinguishable from the fills of said proximal handprints, said distal handprints, said center area footprints and said center area handprints; and a forehead marking located toward the distal end of the mat.

* * * * *